US006755941B2

(12) United States Patent
Rheims et al.

(10) Patent No.: US 6,755,941 B2
(45) Date of Patent: Jun. 29, 2004

(54) APPARATUS FOR LOADING FIBERS WITH CALCIUM CARBONATE

(75) Inventors: Jörg Rheims, Heidenheim (DE); Klaus Doelle, Menasha, WI (US); Oliver Heise, Menasha, WI (US); Werner Witek, Appleton, WI (US)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/098,779

(22) Filed: Mar. 14, 2002

(65) Prior Publication Data

US 2002/0092636 A1 Jul. 18, 2002

Related U.S. Application Data

(62) Division of application No. 09/903,975, filed on Jul. 12, 2001, now Pat. No. 6,599,390.

(30) Foreign Application Priority Data

Jul. 13, 2000 (DE) ..... 100 33 978

(51) Int. Cl.[7] ..... D21H 17/67; D21H 17/70

(52) U.S. Cl. ..... 162/241; 162/181.2; 162/242; 162/243; 422/188; 422/194

(58) Field of Search ..... 162/9, 181.2, 182, 162/183, 241, 242, 243; 422/188, 194

(56) References Cited

U.S. PATENT DOCUMENTS

| | | | | | |
|---|---|---|---|---|---|
| 3,849,247 | A | * | 11/1974 | Richter | 162/237 |
| 4,431,480 | A | * | 2/1984 | Markham et al. | 162/19 |
| 4,842,690 | A | * | 6/1989 | Gazdik et al. | 162/57 |
| 5,096,539 | A | | 3/1992 | Allan | 162/9 |
| 5,223,090 | A | * | 6/1993 | Klungness et al. | 162/9 |
| 5,665,205 | A | | 9/1997 | Srivatsa et al. | 162/181.4 |
| 5,679,220 | A | | 10/1997 | Matthew et al. | 162/181.4 |
| 6,264,794 | B1 | | 7/2001 | Neumann et al. | 162/205 |

FOREIGN PATENT DOCUMENTS

| | | | | |
|---|---|---|---|---|
| EP | 0 457 235 | A1 | 5/1991 | D21H/17/70 |
| EP | 0 791 685 | A2 | 8/1997 | D21H/17/70 |
| GB | 2 265 916 | A | 10/1993 | D21H/15/02 |
| WO | WO 97/01670 | | 1/1997 | D21H/17/67 |

OTHER PUBLICATIONS

Fogler, "Chemical rxn Engineering", FAQ, Chapter 4, University Michican.*

* cited by examiner

*Primary Examiner*—Steve Alvo
(74) *Attorney, Agent, or Firm*—Taylor & Aust, P.C.

(57) ABSTRACT

For a process and an apparatus for loading fibers contained in a pulp suspension with calcium carbonate, a calcium oxide and/or a medium containing calcium hydroxide is fed to the pulp suspension, and the so treated pulp suspension is further charged in several reactors with pure carbon dioxide or a medium containing carbon dioxide. The reactors can be connected in series and/or in parallel.

4 Claims, 1 Drawing Sheet

APPARATUS FOR LOADING FIBERS WITH CALCIUM CARBONATE

This is a divisional of application Ser. No. 09/903,975, filed Jul. 12, 2001, now U.S. Pat. No. 6,599,390.

BACKGROUND OF THE INVENTION

1. Field of the Invention

The invention concerns a process for loading fibers contained in a pulp suspension with calcium carbonate.

2. Description of the Related Art

Pulp suspensions of the above-mentioned type are used especially in paper and cardboard manufacture. The sparing use of raw material resources, due especially to economical and ecological concerns, is reflected in the paper production industry by the use of paper web with lower basis weights, as well as by the partial replacement of pulp with filling materials. If lower cost raw materials are used, the paper quality should at least be maintained. Among other things, the end product's strength, visual characteristics, and processability play key roles in this challenge.

SUMMARY OF THE INVENTION

The present invention relates to a process and apparatus for loading fibers with calcium carbonate, especially in terms of optimum reaction balance, optimum reaction speed and optimum flexibility of production output.

The invention comprises, in one form thereof, a process of fiber loading that includes adding calcium oxide and/or a medium containing calcium hydroxide to a pulp suspension, and then charging the pulp suspension in several reactors with pure carbon dioxide or a medium containing carbon dioxide. Upon the addition of calcium oxide and/or a medium containing calcium hydroxide to the pulp, an exothermic chemical reaction takes place, the calcium hydroxide being added in liquid form (lime milk). By using lime milk, the water settled in or on the pulp suspension's fibrous material is not necessarily required to start and continue the chemical reaction.

Because of this development, the chemical process, which is the basis of the loading, is split into several small processes, thereby permitting an optimum reaction balance, an optimum reaction speed, and an optimum flexibility of production output to be achieved. This use of several small processes enables a targeted and optimal testing of partial reactions, switching on and off of partial reactors and a variation of the operating parameters in the partial reactors.

On loading the fibers, calcium carbonate is imbedded into the wetted fiber surfaces by adding calcium oxide and/or calcium hydroxide to the wet fibrous material. Thereby, at least part of this calcium compound can associate with the water of the pulp mass. The so treated fibrous material is then charged with the pure carbon dioxide or the medium containing carbon dioxide.

As a result, the term "wetted fiber surface" can include all wetted surfaces of the individual fibers. Consequently, the fibers become loaded with calcium carbonate both on their outer surfaces and on their insides (lumen).

Accordingly, the fibers are loaded with the filler material calcium carbonate, whereby the accumulation on the wetted surfaces takes place by a so-called "Fiber Load™" process, as described in U.S. Pat. No. 5,223,090. In this "Fiber Loading™" process, the carbon dioxide reacts with the calcium hydroxide to form water and calcium carbonate.

For one suitable arrangement of the process in conformity with the invention, at least one section of the reactor is connected in series. Several smaller reaction volumes are created from one large reaction volume, so that the reaction speed is increased and, correspondingly, the contact surfaces of the reactants are enlarged. Furthermore, in an advantageous manner, (crystallization-) processes can be achieved in a targeted fashion and the parameters for an optimal reaction can be matched.

With a further advantageous arrangement, at least one section of the reactors is connected in parallel. In addition the above-mentioned advantages, this arrangement also allows for optimum adaptability of the production output. It is also of advantage, in parallel-connected reactors, to produce calcium carbonate with different crystal types and, preferably, to mix these on termination of the production process. This mixing allows an optimal composition of the product.

In certain cases, a combination of series- and parallel-connection of the reactors are of benefit. In this way, the parallel section can be matched to the required production range.

In other respects, the loading of fibers with calcium carbonate is as described in U.S. Pat. No. 5,223,090. The content of that patent is hereby incorporated by reference herein.

The apparatus embodying the invention essentially includes several reactors, in which the pulp suspension, mixed with calcium oxide and/or calcium hydroxide, can be charged with pure carbon dioxide or a medium containing carbon dioxide.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein.

Figure 1:
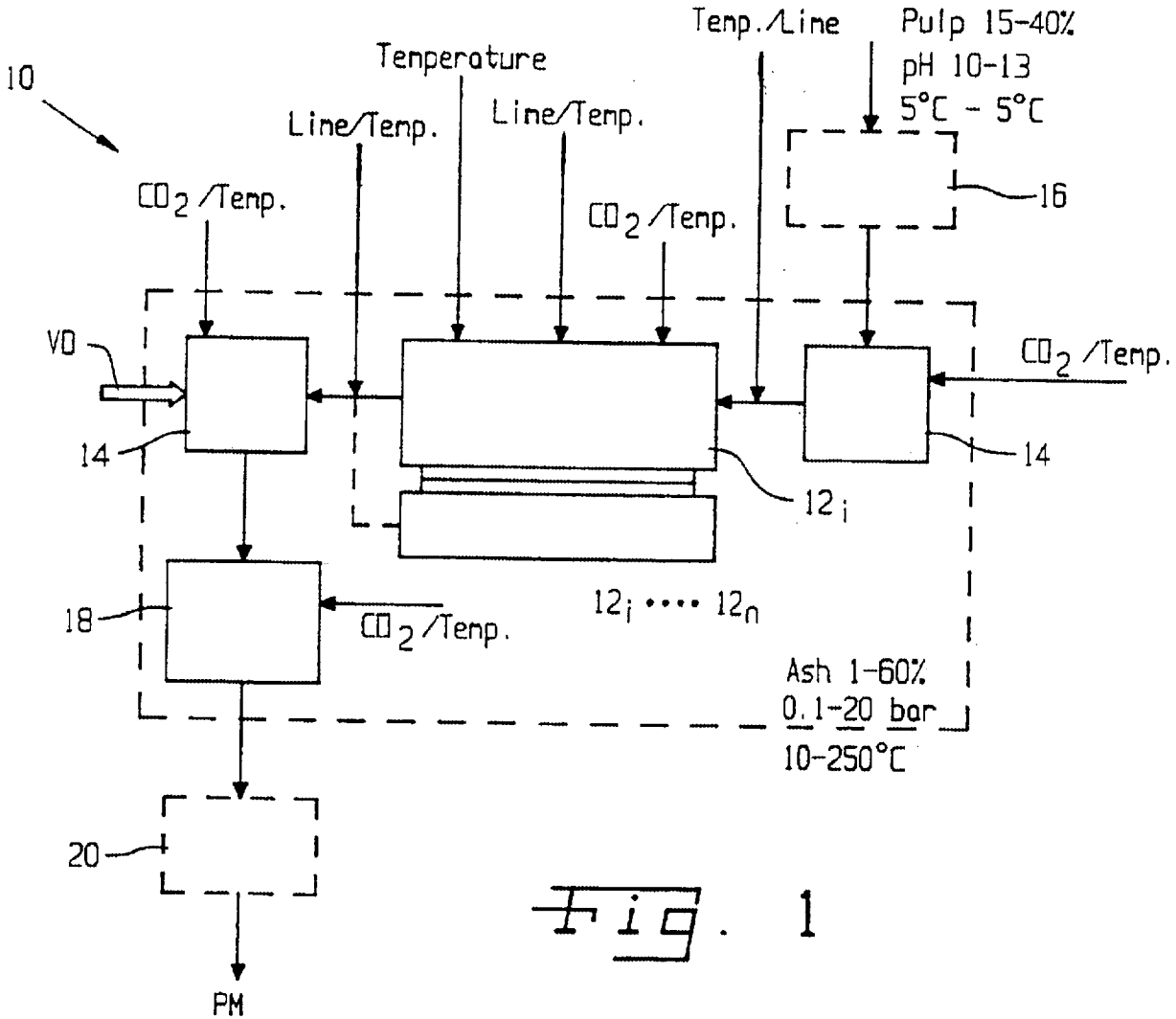
FIG. 1 is a schematic illustration of an embodiment of the fiber loading apparatus of the present invention.

The exemplification set out herein illustrates one preferred embodiment of the invention, in one form, and such exemplification is not to be construed as limiting the scope of the invention in any manner.

DETAILED DESCRIPTION OF THE INVENTION

FIG. 1 shows in schematic an apparatus 10 for loading fibers, contained in a pulp suspension, with calcium carbonate ($CaCO_3$). Correspondingly, apparatus 10 serves to add the calcium carbonate to the wetted fiber surfaces of the fibrous material. In this way, this loading of the fibers, especially in accordance with the aforementioned "Fiber Loading™" process, takes place.

Apparatus 10 includes several reactors 12, in which the pulp suspension, mixed with calcium oxide (CaO) and/or calcium hydroxide ($Ca(OH)_2$) can be charged by pure carbon dioxide ($CO_2$) or by a medium containing carbon dioxide ($CO_2$). Moreover, reactors 12, can be connected in series or parallel. It is possible to have a series arrangement, a parallel arrangement, or a combination arrangement of series and parallel for reactors 12. Also, with parallel-connected reactors 12, it is possible to produce calcium carbonate with different types of crystal and to mix these, preferably on termination of the respective production process.

Before, after and/or within the group of reactors 12, a fluffer 14 can be fitted, in which the fibrous material can be dissociated from the pulp suspension, with the aim to so increase the specific surface area of the fibrous material. Thereby, susceptibility for the reaction products on the fibrous material surface is optimized. Consequently, there is a continuing improvement in the homogenization, and the "Fiber Loading™" process is optimized.

With this design example, first fluffer 14 is fitted between refiner 16 and reactor 12. Alternatively, or additionally, it is also possible to fit such a fluffer 14 between at least one reactor 12 and tank 18. With this example, another refiner 20 follows tank 18. After which, the loaded pulp suspension is fed to paper machine PM.

Via a pressure-reducing device (not shown), the pretreated fibrous material can then be fed, continuously or discontinuously, to one or more material feeds (not shown) of paper machine PM for further preparation. The pressure-reducing device can be a valve, especially a rotary valve, an enclosed worm-wheel, a sectioned sluice, a tank, an expansion device (e.g., such as a nozzle or turbine), and/or another similar device.

For example, by use of apparatus 10, calcium carbonate ($CaCO_3$) can be added to the wetted fiber surfaces of the pulp. This loading of the fibers can then take place according to the aforementioned "Fiber Loading™" process.

Consequently, the calcium oxide and/or the medium containing calcium hydroxide (slaked lime) can be so added to the fibrous material such that at least part of it can associate with the water present in the fibrous material, i.e. between the fibers, in the hollow fibers, and in their walls. As a result, the following chemical reaction takes place:

$$CaO+H_2O \text{ lime slaking} \rightarrow Ca(OH)_2 \text{ slaked lime}$$

In an appropriate reactor, the fibrous material is then so charged with carbon dioxide ($CO_2$) that calcium carbonate ($CaCO_3$) is extensively added to the wetted fiber surfaces. As a result, the following chemical reaction takes place:

"Fiber Loading": $Ca(OH)_2+CO_2 \rightarrow CaCO_3+H_2O$ (Calcium carbonate+water)

Independent of the kind of apparatus in question, various conditions and measures, either individually or in an optional combination, are of benefit with regard to further optimization of the loading process.

The pH value of the pulp suspension can be measured to monitor or regulate the chemical reaction. In doing so, the pH value can be set within a range from about 5.5 to about 10.5.

The ash content of the pulp suspension can be regulated within a range from about 1% to about 70%.

The carbon dioxide can be introduced in a gaseous form. The temperature of the fed carbon dioxide is practically controlled within a range from about −10° C. to about 250° C.

As an example, a pressure regulation in the approximate range from 0.1 bar to 20 bar is possible.

Optical properties can be used as indicators for the regulation of the chemical reaction. For example, these properties can be brightness, luminosity, opacity, color, and light dispersion coefficient.

Fundamentally, it is also possible to use the pH value, the ash component, and/or the calcium carbonate ($CaCO_3$) component as control parameters for controlling the chemical reaction. In the areas identified with "VD" in FIG. 1, dilution ($H_2O$) is also possible.

Also the following conditions and measures, individually or in an optional combination, can provide further optimization of the fiber loading process:

Feed of pulp:

Regulation of volume and mass flow;

Temperature control within a range from about 5° C. to about 95° C.;

Density control in the range from about 15% to about 40%, preferably from about 20% to about 25%;

pH value controllable from about 10 to about 13;

Calcium carbonate (CaCO) in the reactor:

Crystal types: rhombohedral, scalar, rosette, spherical, needle-shaped, prism-shaped, aragonitic, plate-shaped, GCC, and similar crystal structures;

Reaction under about 0.1 bar to about 20 bar;

Temperature from about −10° C. to about 250° C.;

Dwell time from about 0.1 minute to about 1 hour;

Fluffing:

Serves to increase the specific surface area;

Can be fitted before, after and/or within a reactor(s);

Dissociation width from about 0.1 mm to about 100 mm, preferably adjustable;

Energy input within a range from 0.1 kWh/t to 200 kWh/t, preferably 0.5 kWh/t to 9 kWh/t;

Refining:

before, after and/or within a reactor(s) or the "Fiber Loading™" process; Pressure vessel or reactor (*)/dwell pulper after reactor (**)

(*) Crystal types: rhombohedral, scalar, rosette, spherical, needle-shaped, prism-shaped, aragonitic, plate-shaped, GCC and similar crystal structures;

(*) Reaction under about 0.1 bar to about 20 bar;

(**) Temperature within a range from about −10° C. to about 250° C.;

(*) pH value controllable from about 5.5 to about 10.5;

(**) Material density about 0.1% to about 15%;

(**) $CO_2$ addition;

(**) Dwell time; and $CaCO_3$ component in the pulp:

With an underlying percentage by mass of about 1% to about 70% of the filling material, about 1% to about 60% filling material being deposited onto the fibers and the remaining being free FLPCC™ (Fiber Loaded Precipitated Calcium Carbonate) in the suspension.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for loading calcium carbonate into fibers contained in a pulp suspension via a chemical reaction, said apparatus comprising:

a source of a pulp suspension, the pulp suspension including fibers therein, the pulp suspension having a controlled amount and a controlled form of at least one of calcium oxide and calcium hydroxide added thereto to form a controllably variable calcium-treated pulp suspension;

a source of a carbon-dioxide medium, the carbon-dioxide medium being one of pure carbon dioxide and a medium containing carbon dioxide; and a plurality of reactors configured for having the calcium treated pulp suspension and the carbon-dioxide medium charged thereinto and being further configured for promoting variations in the chemical reaction for loading calcium carbonate into the fibers, said plurality of reactors including:

a first reactor configured for receiving a form of said controllably variable calcium treated pulp suspension and said carbon dioxide medium charged thereinto and for loading fibers therein with a first form of calcium carbonate; and a second reactor configured for receiving said carbon dioxide medium and at least one of a form of said controllably variable calcium treated pulp suspension and fibers loaded with calcium carbonate from said first reactor, and means for promoting in said second reactor a chemical reaction to form calcium carbonate different in crystalline form from said calcium carbonate formed in said first reactor, and thereby loading fibers in said second reactor with said different calcium carbonate;

means for selectively adding said carbon-dioxide medium to said pulp suspension upstream of said plurality of reactors, to at least some of said reactors of said plurality of reactors and downstream of said plurality of reactors; and temperature conditioning means connected to selectively operate on said pulp suspension and said carbon-dioxide medium upstream of said plurality of reactors, in at least some of said reactors of said plurality of reactors and downstream of said plurality of reactors.

2. The apparatus of claim 1, wherein said plurality of reactors includes at least one section of reactors, said at least one section of reactors being connected in series.

3. The apparatus of claim 1, wherein said plurality of reactors includes at least one section of reactors, said at least one section of reactors being connected in parallel.

4. The apparatus of claim 1, wherein said plurality of reactors includes a combination of parallel-connected reactors and series-connected reactors.

* * * * *